US005458354A

United States Patent [19]

Bone

[11] Patent Number: 5,458,354

[45] Date of Patent: Oct. 17, 1995

[54] APPARATUS FOR SELECTIVELY PROVIDING ONE OF A PLURALITY OF WORKING SURFACES TO A PERSON IN A WHEELCHAIR

[76] Inventor: Toni L. Bone, 117 Squire Ct., Hot Springs, Ark. 71913

[21] Appl. No.: 276,820

[22] Filed: Jul. 18, 1994

[51] Int. Cl.[6] ..... A47C 7/68

[52] U.S. Cl. ..... 280/304.1; 108/144; 297/148; 297/DIG. 4

[58] Field of Search ..... 280/304.1, 250.1; 297/DIG. 4, 135, 148–151; 312/233, 297; 108/34, 42–44, 160

[56] References Cited

U.S. PATENT DOCUMENTS

| | | | |
|---|---|---|---|
| 1,947,053 | 2/1934 | Mason | 248/460 |
| 2,805,910 | 9/1957 | Townsend | 312/297 |
| 3,294,465 | 12/1966 | Blodee et al. | 312/297 |
| 3,606,450 | 9/1971 | Sedgwick | 297/149 |
| 4,054,315 | 10/1977 | Czarnowski | 297/153 |
| 4,632,451 | 12/1986 | Lee | 280/304.1 |
| 4,662,676 | 5/1987 | Havelock | 297/160 |

*Primary Examiner*—Mitchell J. Hill
*Assistant Examiner*—Victor E. Johnson

[57] ABSTRACT

An apparatus for selectively providing one of a plurality of working surfaces to a person in a wheelchair comprising a planar rigid member with a flat upper surface, a flat lower surface, and an arcuate concave recess formed at its interior edge; a second working surface having an upper surface and a lower surface parallel with the first working surface, and positioned at the outboard end of the first working surface; a plurality of vertically extending walls including an outboard wall coupling the outboard edges of the first and second working surfaces and vertically extending parallel side walls coupling the side edges of the upper and lower working surfaces; a pair of book props secured to the vertical wall at the outboard face of the device with pivot means to allow rotation of the book props independent of each other; and mechanism to couple the lower working surface to a wheelchair.

1 Claim, 4 Drawing Sheets

FIG 1
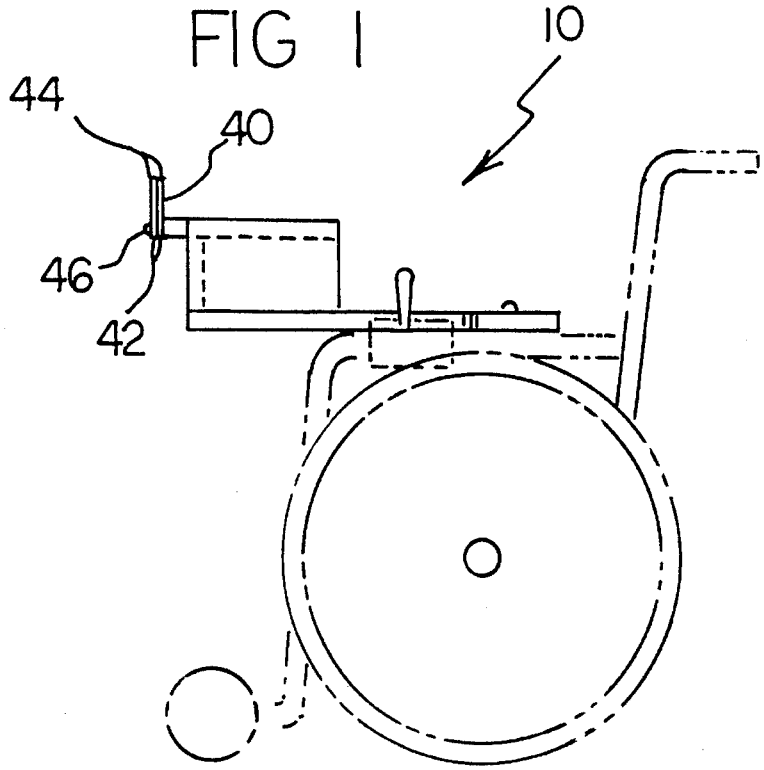
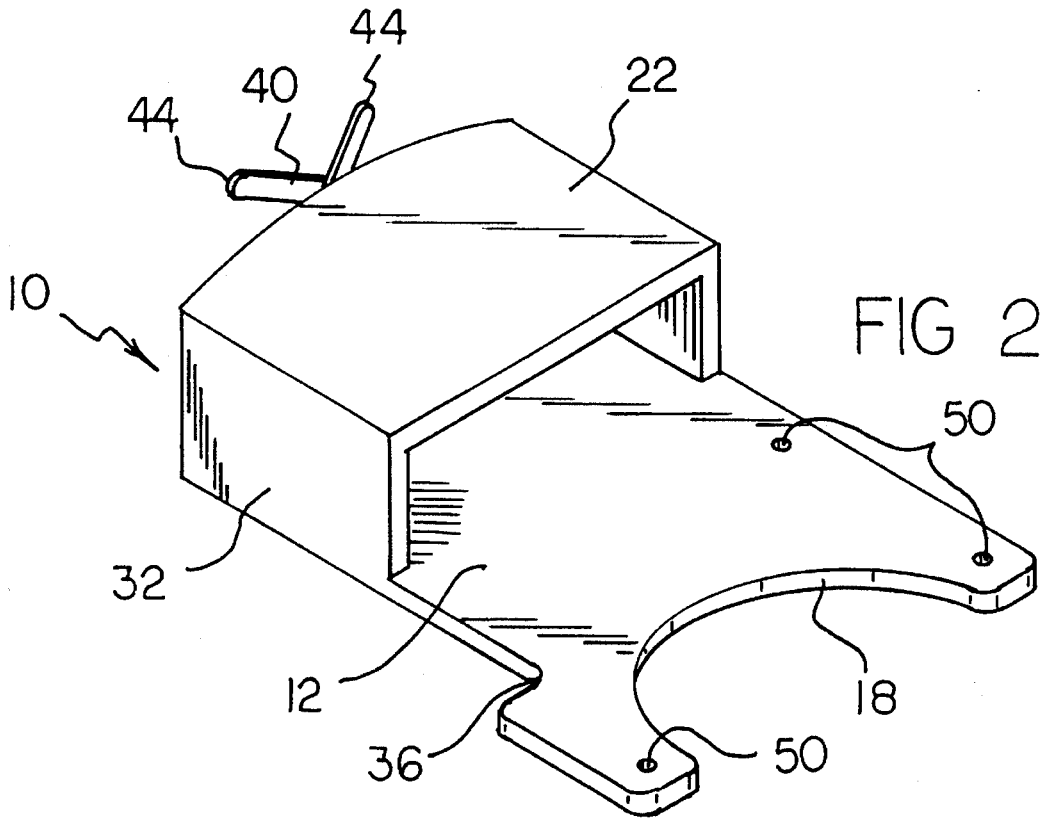
FIG 2

FIG 7
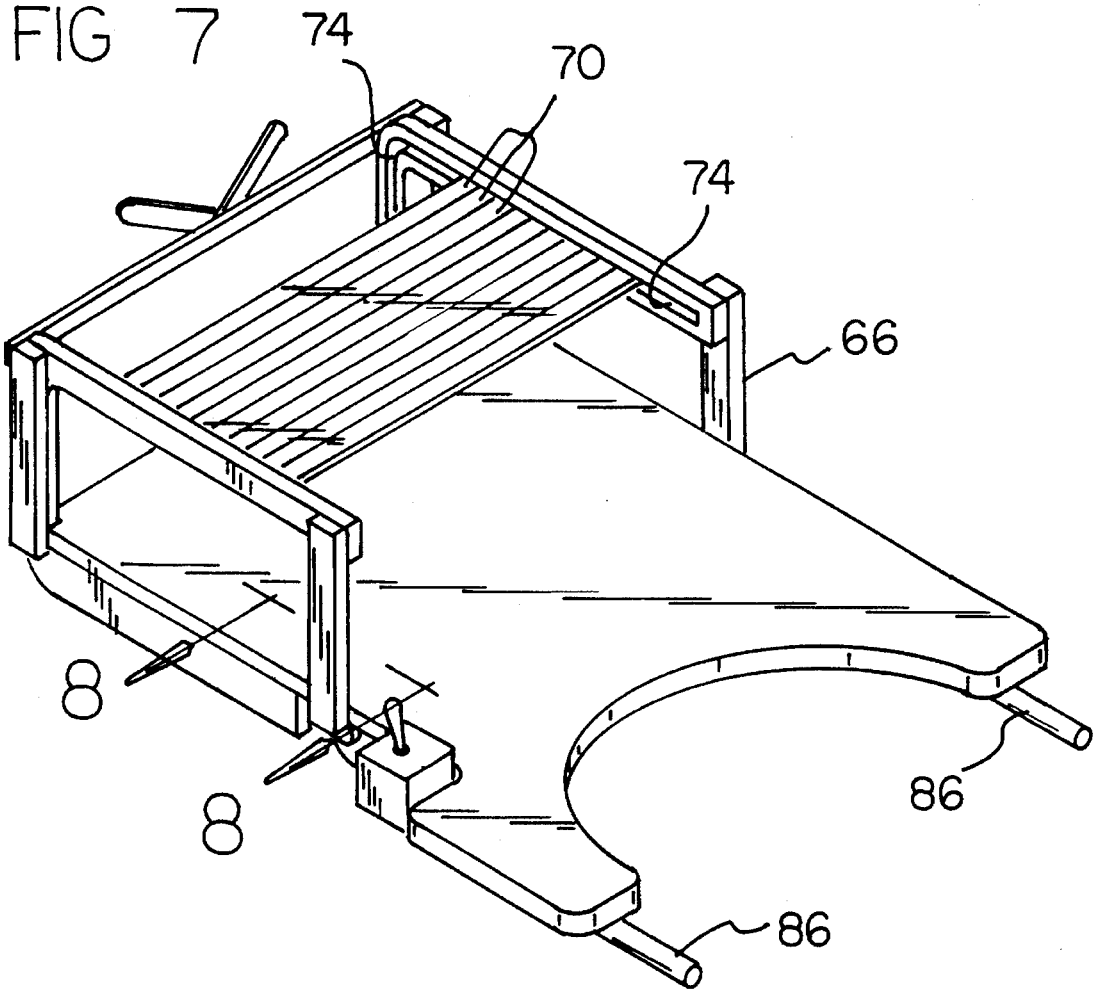
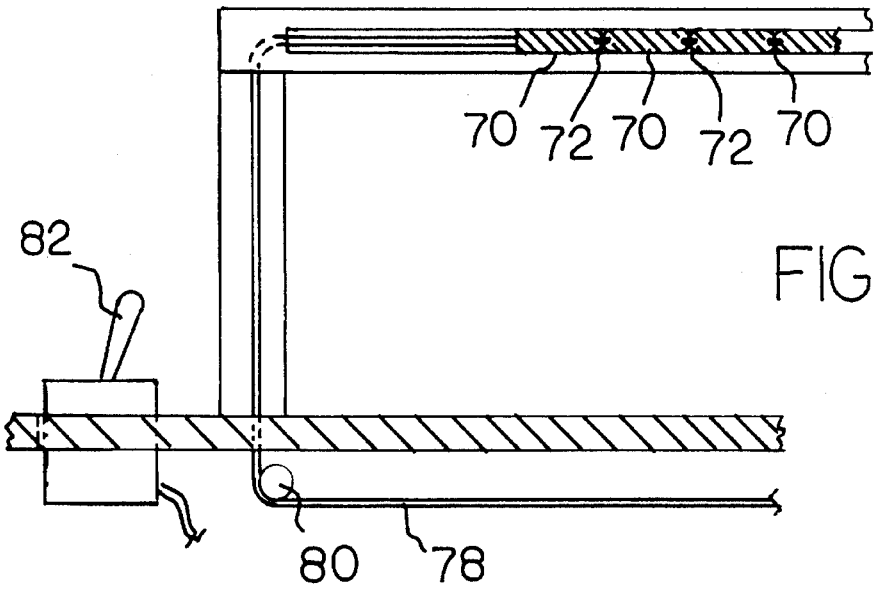
FIG 8

APPARATUS FOR SELECTIVELY PROVIDING ONE OF A PLURALITY OF WORKING SURFACES TO A PERSON IN A WHEELCHAIR

BACKGROUND OF THE INVENTION

1. Field of the Invention

The present invention relates to an apparatus for selectively providing one of a plurality of working surfaces to a person in a wheelchair and more particularly pertains to allowing wheelchair bound people to use working surfaces for eating, writing or the like at a working height which is most comfortable for the particular activity.

2. Description of the Prior Art

The use of tables and desks, including tables and desks mountable with respect to a wheelchair is known in the prior art. More specifically, tables and desks, including tables and desks mountable with respect to a wheelchair heretofore devised and utilized for the purpose of allowing a person in a wheelchair to have access to a working surface for a wide variety of functions are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 3,515,429 to Bollinger discloses a wheelchair tray attachment.

U.S. Pat. No. 4,223,944 to DeLong discloses a retractable wheelchair tray mechanism.

U.S. Pat. No. 4,373,756 to Purdy et al discloses a wheelchair tray assembly.

U.S. Pat. No. 4,659,099 to Malone discloses a food and item tray for a walker and a wheelchair.

U.S. Pat. No. 4,878,685 to Bahm discloses a wheelchair work tray.

In this respect, the apparatus for selectively providing one of a plurality of working surfaces to a person in a wheelchair according to the present invention substantially departs from the conventional concepts and designs of the prior art, and in so doing provides an apparatus primarily developed for the purpose of allowing wheelchair bound people to use working surfaces for eating, writing or the like at a working height which is most comfortable for the particular activity.

Therefore, it can be appreciated that there exists a continuing need for a new and improved apparatus for selectively providing one of a plurality of working surfaces to a person in a wheelchair which can be used for allowing wheelchair bound people to use working surfaces for eating, writing or the like at a working height which is most comfortable for the particular activity. In this regard, the present invention substantially fulfills this need.

SUMMARY OF THE INVENTION

In view of the foregoing disadvantages inherent in the known types of tables and desks, including tables and desks mountable with respect to a wheelchair now present in the prior art, the present invention provides an improved apparatus for selectively providing one of a plurality of working surfaces to a person in a wheelchair. As such, the general purpose of the present invention, which will be described subsequently in greater detail, is to provide a new and improved apparatus for selectively providing one of a plurality of working surfaces to a person in a wheelchair apparatus and method which has all the advantages of the prior art and none of the disadvantages.

To attain this, the present invention essentially comprises a new and improved apparatus for selectively providing one of a plurality of working surfaces to a person in a wheelchair comprising, in combination, a first planar rigid member constituting a first working surface with a flat upper surface, a flat lower surface, and an arcuate concave recess formed at its inbound edge; a second planar rigid member constituting a second working surface with a flat upper surface, a flat lower surface parallel with the first working surface and positioned at the outboard end of the first working surface; a plurality of vertically extending walls including an outboard wall coupling the outboard edges of the first and second working surfaces and vertically extending parallel side walls coupling the side edges of the first and second working surfaces; an indention formed in one side edge remote from the inbound edge whereby the second working surface is offset laterally from the recess; a pair of book props secured to the vertical wall at the outboard edge with pivot means to allow rotation of the book props independent of each other; and apertures formed through the first working surface adjacent to the inboard edge on opposite sides of the recess for coupling to a wheelchair.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for selectively providing one of a plurality of working surfaces to a person in a wheelchair which has all the advantages of the prior art tables and desks, including tables and desks mountable with respect to a wheelchairs and none of the disadvantages.

It is another object of the present invention to provide a new and improved apparatus for selectively providing one of a plurality of working surfaces to a person in a wheelchair which may be easily and efficiently manufactured and marketed.

It is a further object of the present invention to provide a new and improved apparatus for selectively providing one of a plurality of working surfaces to a person in a wheelchair which is of a durable and reliable construction.

An even further object of the present invention is to provide a new and improved apparatus for selectively providing one of a plurality of working surfaces to a person in a wheelchair which is susceptible of a low cost of manufacture with regard to both materials and labor, and which accordingly is then susceptible of low prices of sale to the consuming public, thereby making such tables and desks, including tables and desks mountable with respect to a wheelchairs economically available to the buying public.

Still yet another object of the present invention is to provide a new and improved apparatus for selectively providing one of a plurality of working surfaces to a person in a wheelchair which provides in the apparatuses and methods of the prior art some of the advantages thereof, while simultaneously overcoming some of the disadvantages normally associated therewith.

Still another object of the present invention is to allow wheelchair bound people to use working surfaces for eating, writing or the like at a working height which is most comfortable for the particular activity.

Lastly is an object of the present invention to provide a new and improved apparatus for selectively providing one of a plurality of working surfaces to a person in a wheelchair comprising a planar rigid member with a flat upper surface, a flat lower surface, and an arcuate concave recess formed at its interior edge; a second working surface having an upper surface and a lower surface parallel with the first working surface, and positioned at the outboard end of the first working surface; a plurality of vertically extending walls including an outboard wall coupling the outboard edges of the first and second working surfaces and vertically extending parallel side walls coupling the side edges of the upper and lower working surfaces; a pair of book props secured to the vertical wall at the outboard face of the device with pivot means to allow rotation of the book props independent of each other; and means to couple the lower working surface to a wheelchair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the preferred embodiment of the new and improved apparatus for selectively providing one of a plurality of working surfaces to a person in a wheelchair constructed in accordance with the principles of the present invention.

FIG. 2 is a perspective view of the working surfaces of the device shown in FIG. 1.

FIG. 7 is a perspective illustration of another alternate embodiment of the invention.

FIG. 8 is a cross-sectional view taken along line 8—8 of FIG. 7.

The same reference numerals refer to the same parts through the various Figures.

DESCRIPTION OF THE PREFERRED EMBODIMENT

Figure 4:
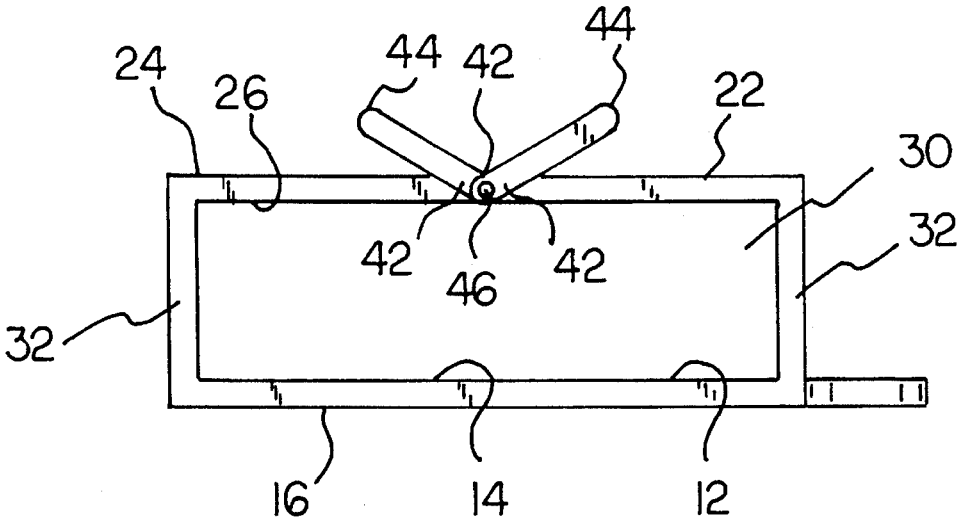
FIG. 4 is a front elevational view of the device shown in the prior Figures taken along line 4—4 of FIG. 3.
Figure 3:
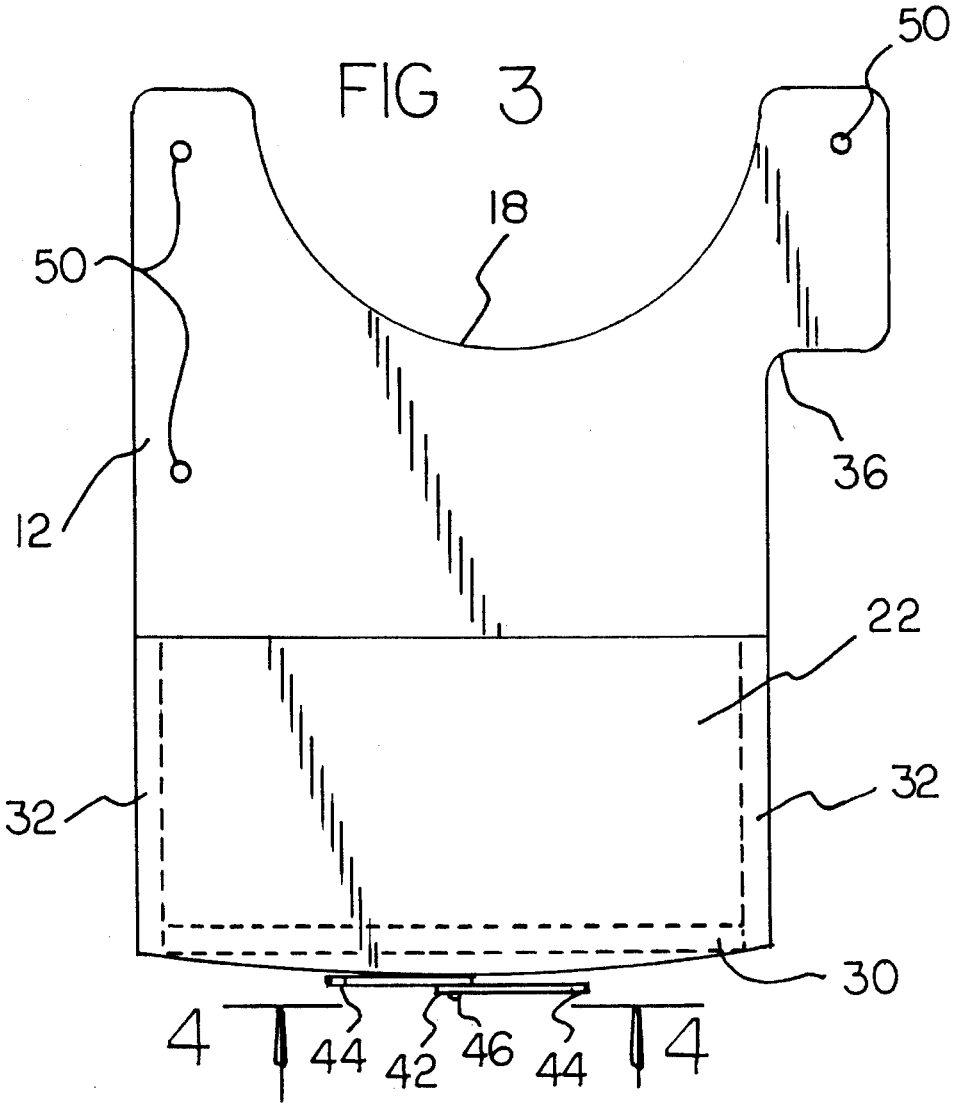
FIG. 3 is a top elevational view of the device of FIGS. 1 and 2.

With reference now to the drawings, and in particular to FIG. 1 thereof, a new and improved apparatus for selectively providing one of a plurality of working surfaces to a person in a wheelchair embodying the principles and concepts of the present invention and generally designated by the reference numeral 10 will be described.

The present invention, the new and improved apparatus for selectively providing one of a plurality of working surfaces to a person in a wheelchair, is comprised of a plurality of components. Such components in their broadest context include a first working surface, a second working surface, vertical walls therebetween, a book prop and coupling means for securement to a wheelchair, while, in alternate embodiments, there are provided a shiftable plate and/or a member formed of discrete rigid strip with hinges therebetween. Such components are individually configured and correlated with respect to each other so as to attain the desired objective.

More specifically, it will be noted that the central component of the present system 10 is a first planar rigid member. Such member constitutes a first working surface 12. Such working surface has a flat upper surface 14 and a parallel flat lower surface 16. Formed in the inboard edge of the first working surface is an arcuate concave recess 18. Such recess is for allowing the first working surface to be positioned partially around a user.

The next component of the system 10 is a second planar rigid member constituting a second working surface 22. The second working surface has a flat upper surface 24 and a flat lower surface 26. Such lower surfaces are parallel with each other and parallel with the first working surface. The outboard edges of the first and second working surfaces are positioned adjacent each other with the second above the first.

Next provided are a plurality of vertically extending walls. Such walls include an outboard wall 30 coupling the outboard edges of the first and second working surfaces. Vertically extending parallel side walls 32 couple the side edges of the first and second working surfaces. The coupling by the side walls is along the entire side edge of the second working surface but is only at the outboard extent of the first working surface.

In addition, an indentation 36 is formed in one side edge of the first working surface remote from the inboard edge. In this manner, the second working surface and the majority of the outboard extent of the first working surface are offset laterally from the recess. This is to allow proper positioning for a right handed user of the system. A left handed user would have the indentation on the side opposite from that shown in the Figures.

Extended utility is provided to the system 10 of the present invention through the use of a pair of book props 40. Such props are simply rods with pivot ends 42 and free ends 44. The props are secured through a pivot pin 46 to the vertical wall of the vertical wall at the outboard edge. The pivot pin is provided to allow rotation of the book props independent of each other for holding a book at the proper orientation for being read.

Next provided are apertures 50. Such apertures are formed through the first working surface. They are located adjacent to the inboard edge. They are positioned on opposite sides of the recess for coupling the device to a wheelchair.

Figure 5:
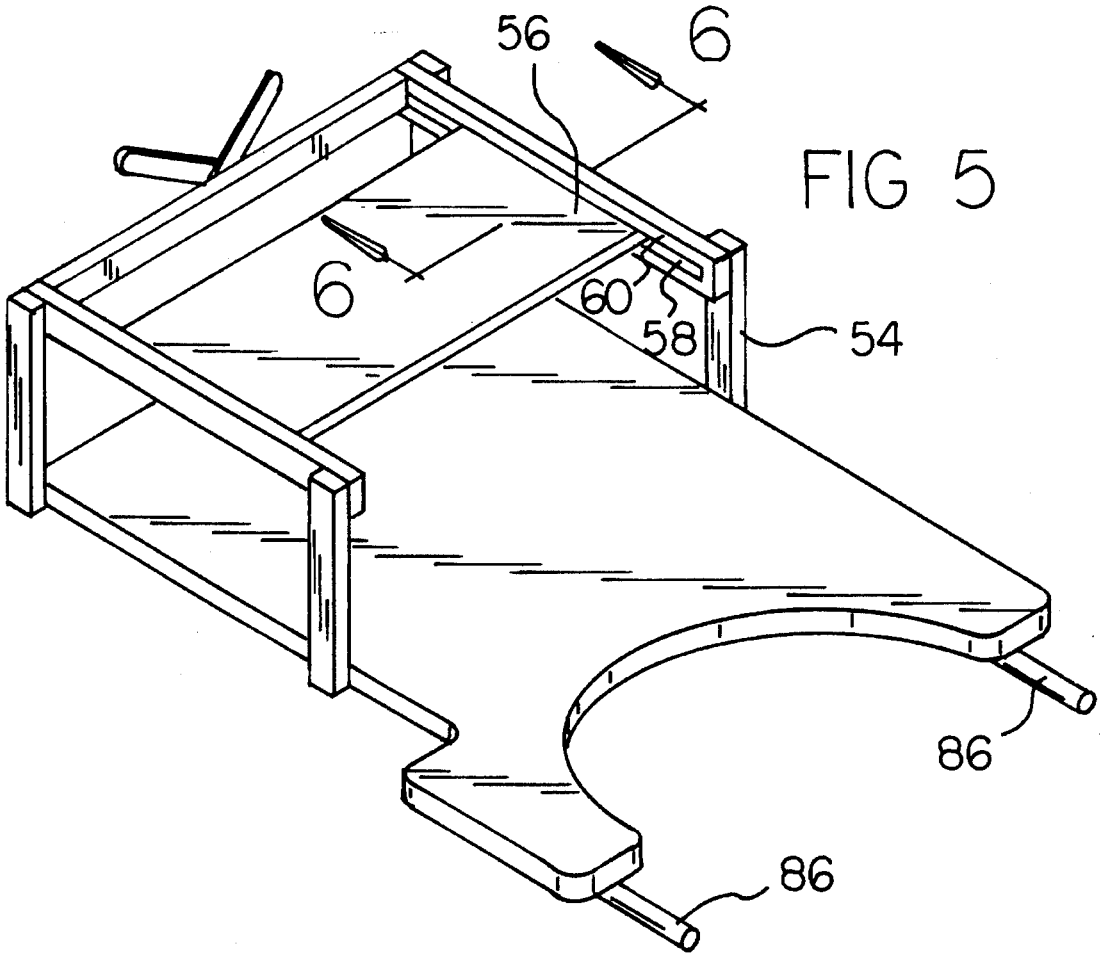
FIG. 5 is a perspective view of an alternate embodiment of the invention.
Figure 6:
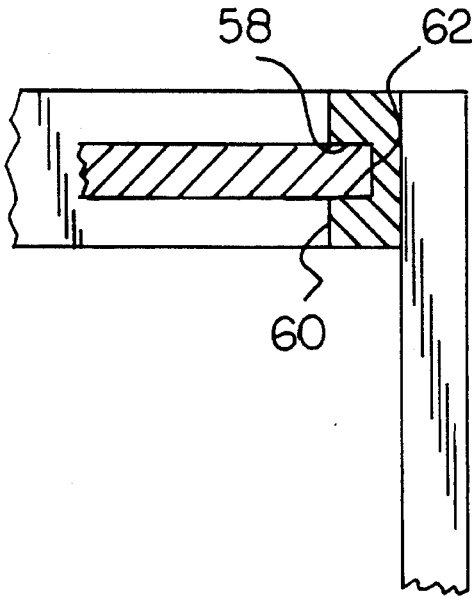
FIG. 6 is a cross sectional view taken along line 6—6 of FIG. 5.

The primary embodiment of the invention is shown in FIGS. 1 through 4. FIGS. 5 and 6 shown an alternate embodiment of the invention. In such embodiment, the second working surface includes a frame 54 and a rigid shiftable plate 56. Also included are parallel slots 58 formed in the interior faces 60 of the frame. The plate is formed with lateral edges 62 slidably secured within the slots. The slots are of a length greater than the length of the plate. This arrangement thereby allows for the sliding movement of the second working surface toward and away from the user as a function of the intended mode of operation of the device at the particular time.

The final embodiment of the invention is shown in FIGS. 7 and 8. According to that embodiment, the second working surface includes a frame 66 and a supplemental member 68. The supplemental member is formed of a plurality of discreet rigid strips 70. The strips extend from side wall to side wall of the device. Hinges 72 are formed at intermediate points between the rigid strips. In addition, C-shaped slots 74 are formed in the frame to face each other. They extend from the interior faces of the frame horizontally then downwardly adjacent to the outboard edge of the vertical walls and then inwardly parallel with the upper slots. This arrangement allows for the moving of the member from an operative position as shown in FIG. 7 where tasks may be performed thereon by a user to an inoperative position beneath the first working surface. Movement of the member between the two positions is effected by sliding the member along the slots.

In the second alternate embodiment, the forward and rearward ends of the member are coupled by a flexible cable 78 in a closed loop configuration for movement around the slots in the frame. A drive mechanism 80 is provided to move the flexible member in a path of movement. In this manner, throwing a switch 82 to energize the power to the system will effect the movement of the member from the upper position as shown in FIGS. 7 and 8 to a lower position beneath the first working surface or to any location therebetween.

The last component of the system 10 is a pair of rods 86. The rods are formed parallel with each other on opposite sides of the recess. The rods are adapted to fit into mating apertures in the arms of wheelchairs. This arrangement is for the more convenient use of the device and its removal from a wheelchair when not in use.

One of the problems confronting anyone in a wheelchair is getting a desk or table which is at a comfortable working height. Often, any table or desk is too low to allow the arms of the wheelchair to fit under it. The present invention is a new wheelchair desk designed to provide the user with a working space that is both convenient and the correct height.

The present invention consists of two desktops, four legs, four rods, two lengths of tracking, a control box, and a holder for reading materials. Both desktops are made of sturdy lightweight plastic or wood. The larger top has a curved cutout in the front. It is mounted on two hollow rods that allow it to slide over the wheelchair arms. The control box is mounted on the left side of the top. The four legs are mounted on each corner of the top. The remaining two stabilizing rods are mounted on opposite sides of the desktop. The lengths of tracking are fastened to the top of these rods, down the back legs, and to the stabilizing rods under the desktop.

The smaller desktop is fastened into these tracks. It is a small flat surface that can slide in the tracks. It could be made from slats rather than one solid piece of wood or plastic, enabling it to extend out halfway over the lower desk top or to be retracted beneath it. The slatted top is extended and retracted by means of a switch on the control box. The book holder is positioned in the center of the top desk area.

The unique design of the unit provides the user with a portable desk with two convenient working surfaces. With the present invention anyone who must use a wheelchair will always be able to have a desk which is the correct height for their wheelchair.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for selectively providing one of a plurality of working surfaces to a person in a wheelchair comprising, in combination:

a first planar rigid member providing a first working surface with a flat upper surface, a flat lower surface, and an arcuate concave recess forming a rearward recessed first edge;

a second planar rigid member constituting a second working surface with a flat upper surface, a flat lower surface parallel with the first working surface and positioned adjacent to the first working surface at a second edge remote from the first edge, the first and second edges of the first and second working surfaces having lateral edges therebetween;

a plurality of vertically extending walls including an outboard wall coupling the the first and second working surfaces and vertically extending parallel side walls coupling the lateral edges of the first and second working surfaces;

a longitudinally extending indentation formed in one of said lateral edges of said first planar rigid member remote from the first edge whereby the second working surface is offset laterally with respect to said recess;

a pair of book props pivotally secured to the second planar rigid member on the second edge with pivot means to allow rotation of the book props independent of each other; and apertures formed through the first working surface adjacent to the first edge adjacent to the recess for coupling said apparatus to a wheelchair.

* * * * *